US007915153B2

(12) United States Patent
Lee et al.

(10) Patent No.: US 7,915,153 B2
(45) Date of Patent: Mar. 29, 2011

(54) PASSIVATION FILM AND METHOD OF FORMING THE SAME

(75) Inventors: Jong Lam Lee, Seoul (KR); Hak Ki Yu, Pohang (KR)

(73) Assignee: LG Electronics Inc., Seoul (KR)

( * ) Notice: Subject to any disclaimer, the term of this patent is extended or adjusted under 35 U.S.C. 154(b) by 74 days.

(21) Appl. No.: 12/292,978

(22) Filed: Dec. 2, 2008

(65) Prior Publication Data

US 2009/0087997 A1 Apr. 2, 2009

Related U.S. Application Data

(63) Continuation-in-part of application No. PCT/KR2007/005363, filed on Oct. 30, 2007.

(30) Foreign Application Priority Data

Oct. 30, 2006 (KR) ..... 10-2006-0105677
Jan. 25, 2007 (KR) ..... 10-2007-0007812

(51) Int. Cl.
*H01J 17/49* (2006.01)

(52) U.S. Cl. ..... 438/535; 313/587; 257/E21.028

(58) Field of Classification Search ..... 438/535, 438/487, 662; 257/E21.028; 313/587
See application file for complete search history.

(56) References Cited

U.S. PATENT DOCUMENTS

2007/0103250 A1* 5/2007 Harris ..... 333/1.1

FOREIGN PATENT DOCUMENTS

JP 1996-077933 A 3/2006
KR 10-2002-0065752 A 8/2002
KR 10-2005-0029255 A 3/2005

* cited by examiner

*Primary Examiner* — Davienne Monbleau
*Assistant Examiner* — Matthew Reames
(74) *Attorney, Agent, or Firm* — KED & Associates LLP

(57) ABSTRACT

A passivation film and a method of forming the same are provided, the passivation film being used in a plasma display panel etc. In the passivation film, a first MgO layer, an intervening layer, and a second MgO layer are laminated and a laser is then irradiated to oxidize the intervening layer. Simultaneously, defects are formed at the interfaces of the first and second MgO layers. Accordingly, a plasma discharge firing voltage greatly decreases, and the total power consumption of the plasma display panel is significantly reduced.

16 Claims, 3 Drawing Sheets

PASSIVATION FILM AND METHOD OF FORMING THE SAME

This application is a Continuation-In-Part Application of PCT International Application No. PCT/KR2007/005363 filed on Oct. 30, 2007, which designated the United States.

FIELD OF THE INVENTION

The present invention relates to a passivation film and a method of forming the same, and more particularly, to a passivation film, which can improve discharge characteristic of an MgO layer widely used in a plasma display panel (PDP), and a method of forming the same.

BACKGROUND OF THE INVENTION

Generally, plasma display panels are display devices in which ultraviolet (UV) light generated by gas discharge within discharge cells excites phosphors to display images. Plasma display panels are considered as next generation flat panel display devices because they can realize large-sized high-resolution display screens.

A plasma display panel configuration including a rear plate provided with an address electrode, a barrier rib, and a phosphor layer corresponding to each discharge cell, and a front plate provided with a discharge sustaining electrode having a scan electrode and a display electrode is introduced as an example of plasma display panel. The address electrode and the discharge sustaining electrode are covered with dielectric layers, and inside of the discharge cell is filled with a discharge gas. In such a PDP, an address discharge is generated when an address voltage is applied between the address electrode and the scan electrode. Due to the address discharge, wall charges are accumulated on the dielectric layers formed on the address electrode and the discharge sustaining electrode. In this way, a discharge cell in which a main discharge is to be triggered is selected. Then, when a sustain voltage is applied between the scan electrode and the display electrode of the selected discharge cell, positive ions accumulated on the scan electrode collide with electrons accumulated on the display electrode, thereby triggering the main discharge. The main discharge lowers an energy level of excited xenon (Xe) to emit UV light. The emission of UV light excites the phosphor coated inside the discharge cell. A visible light is emitted while an energy level of the excited phosphor is lowered. An image is reproduced by the emission of visible light.

When the plasma discharge occurs in the discharge cell, a magnesium oxide (MgO) layer on the dielectric layer of the front plate is directly exposed to plasma and thus is directly involved in the plasma discharge initiation and sustaining. In addition, the MgO layer is closely associated with electrical and optical characteristics of the PDP. A high secondary electron emission coefficient of the MgO layer decreases a discharge voltage of the discharge cell, thus reducing the total power consumption, and a high plasma ion durability plays an important role in extending the lifetime of the PDP. Furthermore, because the MgO layer has a high band gap energy of more than 7.8 eV, it can efficiently transmit the visible light generated when the UV light excites the phosphor.

Currently, the MgO layer of the PDP is formed on the dielectric layer of the front plate by E-beam evaporation, ion plating, etc. The MgO layer is directly associated with the plasma discharge and plays a crucial role in determining the total power consumption of the PDP. Hence, many researches and developments have been briskly conducted to reduce the plasma discharge firing voltage of the MgO layer. One of them is to adjust the crystallinity, density, and stress of the MgO layer through deposition and doping, and another is to form a new material for a passivation film which has better characteristics than the MgO layer. Meanwhile, the secondary electrons emitted from the MgO layer directly inducing the plasma discharge absorb and emit the energy generated when electrons inside the MgO layer tunnel into the MgO layer and are neutralized with positive ions of inert gas, e.g., neon (Ne). Therefore, the secondary electron emission is greatly dominated by surface characteristics rather than bulk characteristics such as the crystallinity, density, and stress of the MgO layer. However, studies based on this theory have not been sufficiently conducted. As one of efforts to substitute for the MgO layer, new materials for passivation films having good discharge characteristics have been reported, but their reliabilities are low compared with the MgO layer. Therefore, the new materials cannot be used in an actual manufacturing process.

Consequently, there is a limitation in researching and developing a passivation film having a low discharge firing voltage.

SUMMARY OF THE INVENTION

The present disclosure provides a passivation film which is formed as a multi-layered structure of MgO layer, oxide layer and MgO layer, whereby the potential barrier of secondary electron emission is lowered to reduce a discharge firing voltage and power consumption, and a method of forming the same.

The present disclosure also provides another passivation film and a method of forming the same. More specifically, an intervening layer susceptible to oxidation is formed between MgO layers and a laser is irradiated to oxidize the intervening layer. At this point, defects are generated at the interface between the MgO layer and the intervening layer. These defects lower the potential barrier of secondary electron emission necessary for plasma discharge, thereby reducing a discharge firing voltage and power consumption.

In accordance with an exemplary embodiment, a passivation film includes: a substrate in which a predetermined structure is formed; and a first MgO layer, an intervening layer, and a second MgO layer, which are sequentially laminated on the substrate.

The substrate may include an electrode, and a dielectric layer disposed on the substrate including the electrode.

The passivation may film include oxygen vacancies formed between the first and second MgO layers, and the intervening layer.

The intervening layer may be oxidized by irradiation of a laser.

In accordance with another exemplary embodiment, a method of forming a passivation film includes: sequentially forming a first MgO layer, an intervening layer, and a second MgO layer on a substrate in which a predetermined structure is formed; and irradiating a laser to oxidize the intervening layer, thereby forming an oxide layer, and forming oxygen vacancies at interface between the first and second MgO layers, and the oxide layer.

The method may further include: forming an electrode on the substrate; and forming a dielectric layer on the substrate including the electrode.

The first and second MgO layer may be formed using one of E-beam evaporation, ion plating, and RF reactive sputtering.

The intervening layer may be formed by the same process as the first and second MgO layers.

The intervening layer may be formed of a metal layer or a semiconductor layer. The metal layer may be formed of a metal selected form the group consisting of In, Ti, Ta, Nb, Y, Al, V, Zr, Cr and combinations thereof. The semiconductor layer may be formed of one of Si, Ge and combinations thereof. The semiconductor layer may be formed of a material having an energy band gap smaller than that of the laser.

The laser may use a gas selected from the group consisting of ArF, KrCl, KrF, XeCl, and XeF.

The second MgO layer may be formed to have a thickness with which the laser is transmitted and the oxygen vacancies are formed.

In accordance with the exemplary embodiments, the first MgO layer, the intervening layer, and the second MgO layer are laminated and the laser is then irradiated to oxidize the intervening layer. Simultaneously, defects are generated at the interface between the first and second MgO layers, and the intervening layer. Therefore, the plasma discharge firing voltage greatly decreases, thereby reducing the total power consumption of the PDP significantly. Because the typical MgO layer is used as it is and the intervening layer is deposited in the same equipment as the MgO layer, the existing apparatuses can be used without modification. Furthermore, because the intervening layer is oxidized by the irradiation of a laser, separate thermal treatments for oxidizing the intervening layer are unnecessary, thereby deformation of the PDP and characteristic variation of the PDP which may be caused by the thermal treatments can be prevented.

BRIEF DESCRIPTION OF THE DRAWINGS

Exemplary embodiments can be understood in more detail from the following description taken in conjunction with the accompanying drawings, in which.

DETAILED DESCRIPTION OF THE EMBODIMENT

Hereinafter, specific embodiments will be described in detail with reference to the accompanying drawings.

Figure 1:
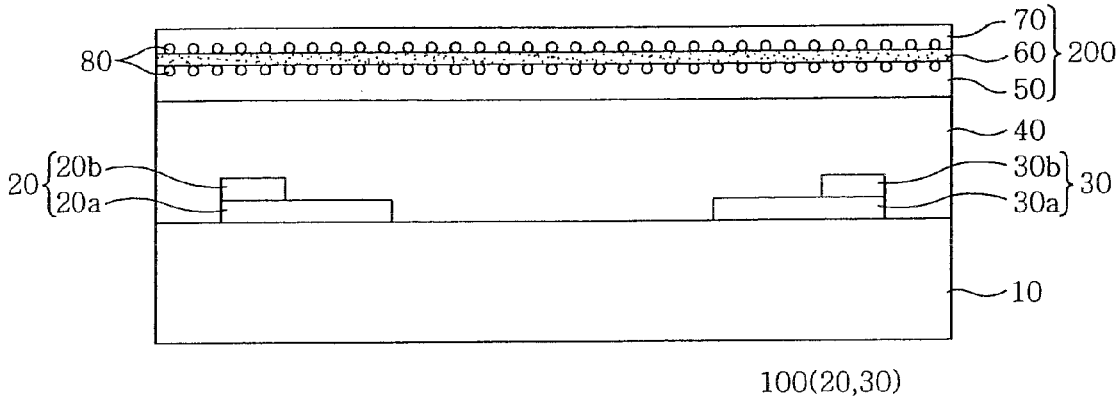
FIG. 1 is a cross-sectional view of a plasma display panel having a passivation film in accordance with an exemplary embodiment.

FIG. 1 is a cross-sectional view illustrating a front plate of a plasma display panel in accordance with an exemplary embodiment.

Referring to FIG. 1, a scan electrode 20 and a display electrode 30 are disposed on a glass substrate 10 to be spaced apart from each other by a predetermined distance as a discharge sustaining electrode 100. the scan electrode 20 includes a transparent electrode 20*a* and a bus electrode 20*b* disposed on a portion of the top surface of the transparent electrode 20*a*, and the display electrode 30 includes a transparent electrode 30*a* and a bus electrode 30*b* disposed on a portion of the top surface of the transparent electrode 30*a*. The transparent electrodes 20*a* and 30*a* are formed of a transparent conductive material, e.g., indium tin oxide (ITO), indium zinc oxide (IZO), etc., considering their transmittance. In order to compensate high resistance of the transparent electrodes 20*a* and 30*a*, the bus electrodes 20*b* and 30*b* are formed of a single layer of Ag or a laminated layer of Cr, Cu and Cr. A dielectric layer 40 is disposed on the glass substrate 10 including the scan electrode 20 and the display electrode 30. The dielectric layer 40 prevents the scan electrode 20 and display electrode 30, which are adjacent together, form being directly electrically connected to each other during a discharge operation and prevents the scan electrode 20 and the display electrode 30 from being damaged due to direct collision of positive ions or electrons against the scan electrode 20 or the display electrode 30. In addition, the dielectric layer 40 can induce charges and accumulate wall charges. The dielectric layer 40 is formed of dielectric having a high light transmittance, for example, one of PbO, $B_2O_3$, $SiO_2$ and combinations thereof. Further, the dielectric layer 40 is formed to have a sufficient thickness so that it is not damaged even when the scan electrode 20 and the display electrode 30 are driven. However, if the dielectric layer 40 is too thick, an address voltage increases and a material is wasted. A passivation film 200 having a multi-layered structure of a first MgO layer 50, an oxide layer 60, and a second MgO layer 70, which are laminated on the dielectric layer 40, is formed. The oxide layer 60 may be formed of, for example, metal oxide or silicon oxide layer. The oxide layer 60 is formed by oxidizing a material that is easily oxidized, for example, the forming of the oxide layer 60 may include forming a metal layer or a silicon layer and oxidizing the metal layer or the silicon layer by irradiating a laser on the second MgO layer 70. At this point, defects such as oxygen vacancies 80 are generated a lot at the interface between the oxide layer 60 and the second MgO layer 70. The oxygen vacancies 80 generated a lot in the interfaces of the first and second MgO layers 50 and 70 lower the potential barrier of secondary electron emission necessary for plasma discharge, thereby reduces discharge firing voltage of the plasma display panel and thus reduce the total power consumption.

Figure 2:
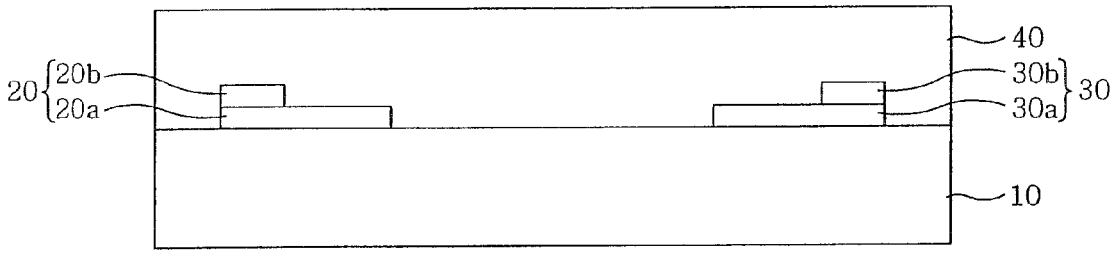
FIGS. 2 through 4 are cross-sectional views of a plasma display panel illustrating a method of manufacturing the passivation film in accordance with the exemplary embodiment.
Figure 3:
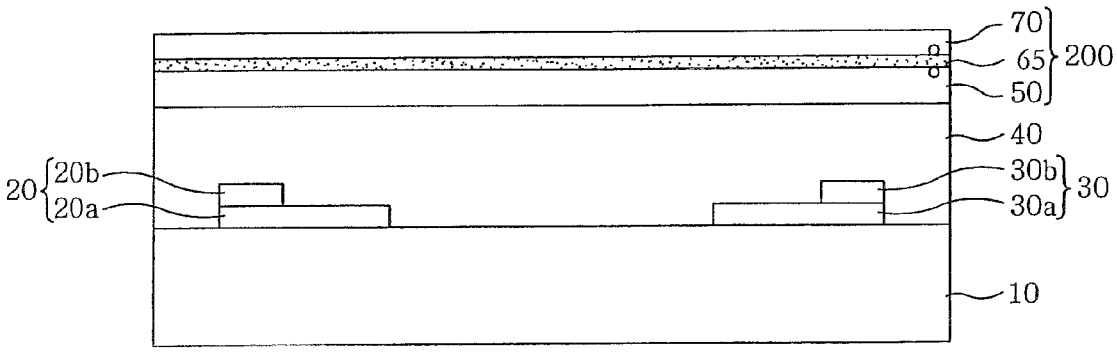
Figure 4:
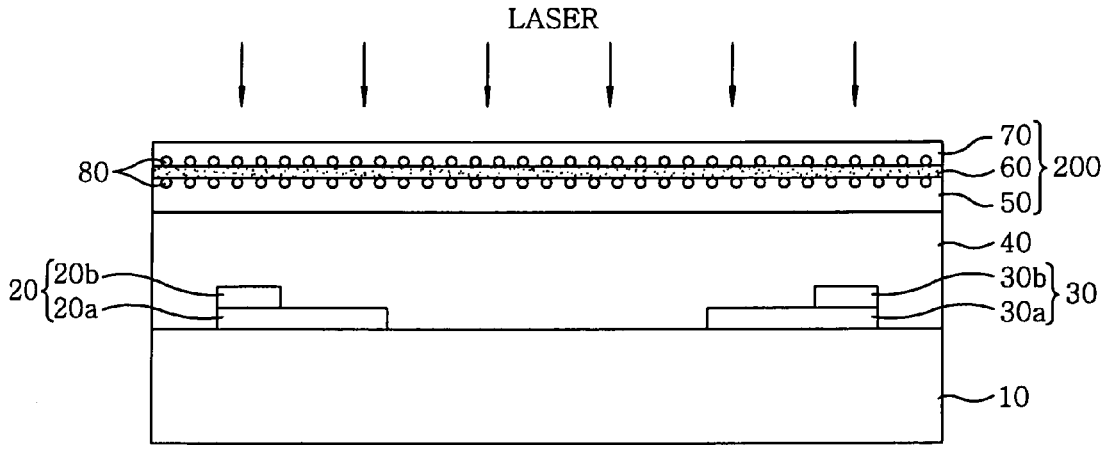

FIGS. 2 through 4 are cross-sectional views illustrating a method of manufacturing a plasma display panel in accordance with an exemplary embodiment.

Referring to FIG. 2, transparent electrodes 20*a* and 30*a* are formed on a predetermined region of a glass substrate 10, spaced apart from each other by a predetermined distance. The transparent electrodes 20*a* and 30*a* are formed by depositing a transparent conductive material, e.g., ITO or IZO, on the glass substrate 10 and by patterning them. Then, bys electrodes 20*b* and 30*b* are formed on the transparent electrodes 20*a* and 30*a*, respectively. In order to compensate high resistance of the transparent electrodes 20*a* and 30*a*, the bus electrodes 20*b* and 30*b* are formed of a single layer of Ag or a laminated layer of Cr, Cu and Cr at edges of the transparent electrodes 20*a* and 30*a*. At this point, the transparent electrode 20*a* and the bus electrode 20*b* define a scan electrode 20, and the transparent electrode 30*a* and the bus electrode 30*b* define a display electrode 30. A pair of the scan electrode 20 and the display electrode 30 serves as a discharge sustaining electrode 100. A dielectric layer 40 is formed on the glass substrate 10 in which the discharge sustaining electrode 100 is formed. The dielectric layer 40 is formed of a dielectric material, e.g., PbO, $B_2O_3$, $SiO_2$, etc. The dielectric layer 40 is formed to have a sufficient thickness so that it is not damaged even when the discharge sustaining electrode 100 is driven.

Referring to FIG. 3, a first MgO layer 50, a metal layer 65, and a second MgO layer 70 are sequentially formed on the dielectric layer 40. The first MgO layer 50 and the second MgO layer 70 are formed using thin-film forming processes, e.g., E-beam evaporation, ion plating, RF reactive sputtering, etc. The metal layer 65 is formed using the same process as the first and second MgO layers 50 and 70. Furthermore, the metal layer 65 is formed of a metal that is easily oxidized, for example, In, Ti, Ta, Nb, Y, Al, V, Zr, Cr, etc.

Referring to FIG. 4, a laser is irradiated on the second MgO layer 70. The laser passes through the second MgO layer 70 and is absorbed by the metal layer 65. An energy of the laser absorbed by the metal layer 65 is dispersed into the first and second MgO layers 50 and 70 disposed under and above the metal layer 65. Due to the energies dispersed into the first and second MgO layers 50 and 70, oxygens are decomposed from the first and second MgO layers 50 and 70. The metal layer 65 reacts with the decomposed oxygens and thus is oxidized to form an oxide layer 60. At this point, defects such as oxygen vacancies 80 are generated a lot at the interface between the first MgO layer 50 and the oxide layer 60 and the interface between the oxide layer 60 and the second MgO layer 70. In this case, the laser is irradiated within an energy range where the metal layer 65 can be oxidized without damaging the second MgO layer 70. To this end, the laser is irradiated at a wavelength of approximately 200-400 nm. Gas lasers such as ArF, KrCl, KrF, XeCl, XeF, etc. may be used. Furthermore, the second MgO layer 70 may be formed to have a thickness of approximately 0.5-100 nm so as to effectively transmit the laser and generate the oxygen vacancies 80 in the second MgO layer 70 during the oxidation of the metal layer 65. Meanwhile, if the metal layer 65 is too thick, it is not fully oxidized and a large amount of oxygens are decomposed from the first and second MgO layers 50 and 70. On the other hand, if the metal layer 65 is too thin, it is oxidized before a desired amount of oxygens are decomposed from the first and second MgO layers 50 and 70. Therefore, the metal layer 65 is formed to have an appropriate thickness so that a desired amount of oxygen vacancies can be generated in the first and second MgO layers 50 and 70.

Figure 5:
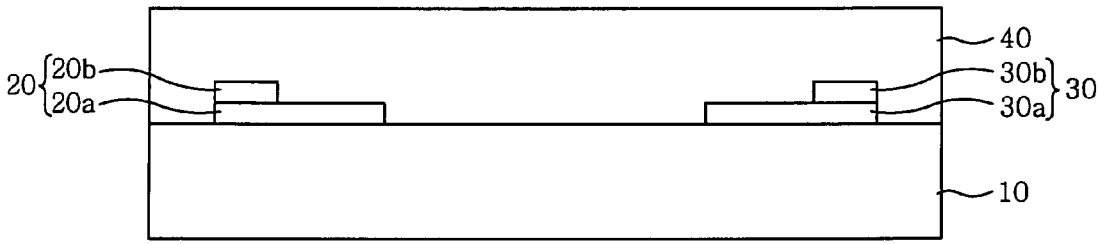
FIGS. 5 through 7 are cross-sectional views of a plasma display panel illustrating a method of manufacturing a passivation film in accordance with another exemplary embodiment.
Figure 6:
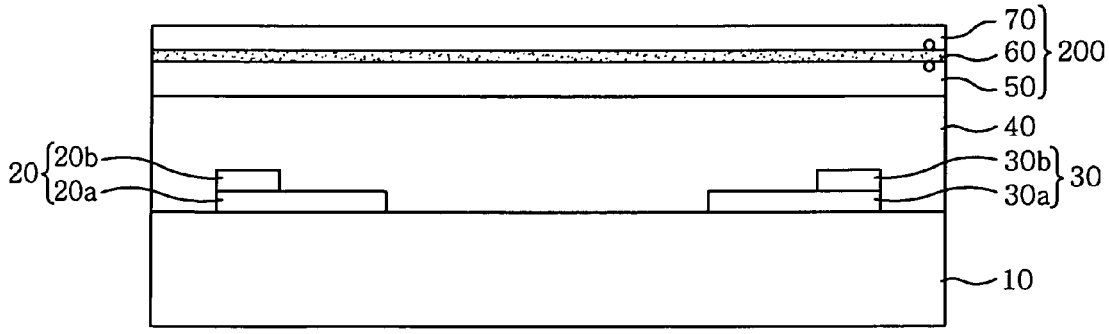
Figure 7:
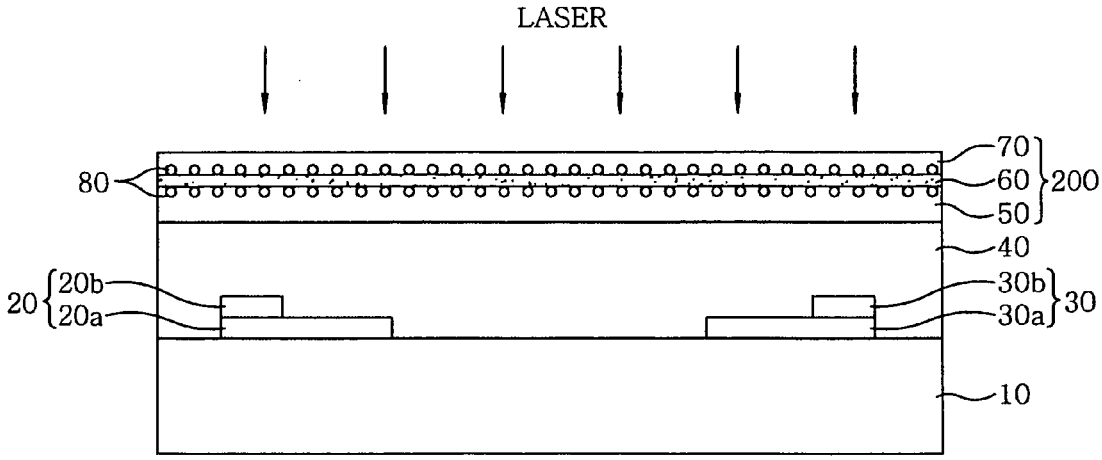

FIGS. 5 through 7 are cross-sectional views of a device sequentially illustrated to describe a method of manufacturing a plasma display panel in accordance with another exemplary embodiment. The overlapping description with FIGS. 2 through 4 will be omitted for conciseness, and differentiated parts will be focused in the following description.

Referring to FIG. 5, transparent electrodes 20*a* and 30*a* are formed on a glass substrate 10, spaced apart from each other by a predetermined distance. Bus electrodes 20*b* and 30*b* are then formed on the transparent electrodes 20*a* and 30*a*, respectively. The transparent electrode 20*a* and the bus electrode 20*b* define a scan electrode 20, and the transparent electrode 30*a* and the bus electrode 30*b* define a display electrode 30. A pair of the scan electrode 20 and the display electrode 30 serves as a discharge sustaining electrode 100. A dielectric layer 40 is formed on the glass substrate 10 in which the discharge sustaining electrode 100 is formed.

Referring to FIG. 6, a first MgO layer 50, a semiconductor layer 85, and a second MgO layer 70 are sequentially formed on the dielectric layer 40. The semiconductor layer 85 is formed of Si, Ge, etc. The semiconductor layer 85 is formed of a material having an energy band gap smaller than that corresponding to a laser wavelength to be used. The reason for this is that the semiconductor layer 85 can absorb the laser only when its energy band gap is smaller than that corresponding to the laser wavelength. For example, because a KrF laser having a wavelength of 248 nm has an energy band gap of approximately 5 eV, the semiconductor layer 85 can be formed of Si having an energy band gap of 1.1. eV.

Referring to FIG. 7, a laser is irradiated on the second MgO layer 70. The laser passes through the second MgO layer 70 and is absorbed by the semiconductor layer 85. An energy of the laser absorbed by the semiconductor layer 85 is dispersed into the first and second MgO layers 50 and 70 disposed under and above the semiconductor layer 85. Due to the energy dispersed into the first and second MgO layers 50 and 70, oxygens are decomposed from the first and second MgO layers 50 and 70. The semiconductor layer 85 reacts with the decomposed oxygens and thus is oxidized to form an oxide layer 60. At this point, defects such as oxygen vacancies 80 are generated a lot at the interface between the first MgO layer 50 and the oxide layer 60 and the interface between the oxide layer 60 and the second MgO layer 70. In this case, the laser is irradiated within an energy range where the semiconductor layer 85 can be oxidized without damaging the second MgO layer 70. Gas lasers such as ArF, KrCl, KrF, XeCl, XeF, etc. may be used.

Figure 8:
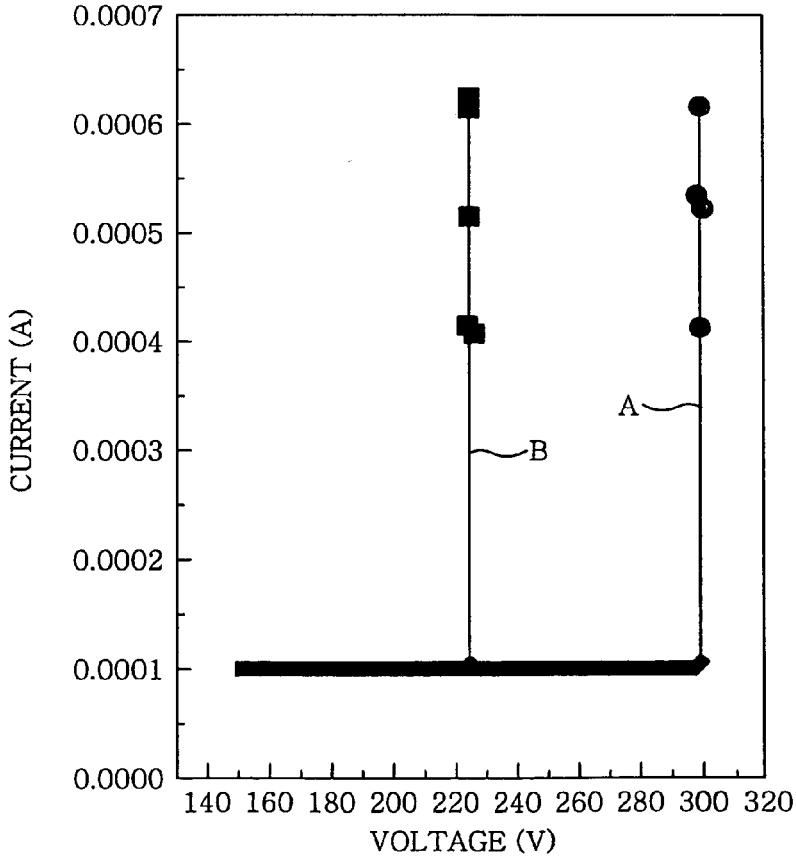
FIG. 8 is a graph illustrating plasma discharge characteristics of a conventional single-layered MgO passivation film and a multi-layered passivation film in accordance with the present invention.

FIG. 8 is a graph illustrating variation of plasma discharge characteristics of a conventional single-layered MgO passivation film and a multi-layered passivation film of the present invention. In order to measure the variation of plasma discharge characteristics, the passivation film is placed in a cathode and a plasma discharge gas is injected between the cathode and a Cu anode. The cathode and the anode are spaced apart by a predetermined distance, and then a predetermined voltage is applied to the cathode and the Cu anode to locate a point at which a critical current increases. The point at which the critical current increases is defined as a discharge firing voltage. Inert gases such as He, Ar, Ne, and Xe, and mixtures thereof can be used as the discharge gas.

In this exemplary embodiment, the first MgO layer was deposited to have a thickness of 700 nm at 250° C. using the E-beam evaporator. A deposition rate was 2 nm/sec. The Cr layer was deposited on the first MgO layer to have a thickness of 1 nm at 250° C. using the E-beam evaporator, and the second MgO layer was deposited on the Cr layer to have a thickness of 15 nm under the same conditions as the first MgO layer. The KrF gas laser was irradiated to the laminated structure of the first MgO layer, the Cr layer, and the second MgO layer at the energy of 500 mJ for 3 seconds. Ne gas mixed with 10% Xe was used to measure the discharge, and the discharge characteristics were compared at a 5.4 Torr cm, which is the actual discharge region of the PDP. As can be seen in the figure, the discharge firing voltage B of the multi-layered passivation film in accordance with the exemplary embodiment of the present invention was reduced by 71 V, compared with the conventional single MgO layer.

Although the multi-layered passivation films applied to the plasma display panel have been described, they can also be applied to a variety of devices that are exposed to plasma.

Although the passivation film and the method of forming the same have been described with reference to the specific embodiments, they are not limited thereto. Therefore, it will be readily understood by those skilled in the art that various modifications and changes can be made thereto without departing from the spirit and scope of the present invention defined by the appended claims.

What is claimed is:

1. A plasma display panel, comprising:

a substrate;

an electrode formed over the substrate;

a dielectric layer formed over the substrate including the electrode; and a passivation layer formed over the dielectric layer and including a first MgO layer, an intervening layer, and a second MgO layer.

2. The plasma display panel of claim 1, wherein oxygen vacancies are formed between the first and second MgO layers, and the intervening layer.

3. The plasma display panel of claim 1, wherein the intervening layer is an oxide layer.

4. A method of forming a passivation film, comprising:

sequentially forming a first MgO layer, an intervening layer, and a second MgO layer on a substrate; and forming an oxide layer and oxygen vacancies by irradiating a laser to the intervening layer.

5. The method of claim 4, wherein the oxide layer is formed by oxidation of the intervening layer by the irradiated laser.

6. The method of claim 4, wherein the oxygen vacancies are formed at interfaces between the first and second MgO layers and the oxide layer.

7. The method of claim 4, further comprising:

forming an electrode on the substrate; and forming a dielectric layer on the substrate including the electrode.

8. The method of claim 4, wherein the first MgO layer and the second MgO layer are formed using one of E-beam evaporation, ion plating, or RF reactive sputtering.

9. The method of claim 4, wherein the intervening layer is formed by a same process used to form the first and second MgO layers.

10. The method of claim 4, wherein the intervening layer is formed of a metal layer or a semiconductor layer.

11. The method of claim 10, wherein the metal layer is formed of a metal selected from the group consisting of In, Ti, Ta, Nb, Y, Al, V, Zr, Cr and combinations thereof.

12. The method of claim 10, wherein the semiconductor layer is formed of one of Si, Ge or a combination thereof.

13. The method of claim 10, wherein the semiconductor layer is formed of a material having an energy band gap smaller than that of the laser.

14. The method of claim 4, wherein the laser uses a gas selected from the group consisting of ArF, KrCl, KrF, XeCl, and XeF.

15. The method of claim 4, wherein the second MgO layer is formed to have a thickness with which the laser is transmitted and the oxygen vacancies are formed.

16. The plasma display panel of claim 1, wherein the first MgO layer, the intervening layer, and the second MgO layer are sequentially laminated over the dielectric layer.

* * * * *